United States Patent [19]

Bolton

[11] 4,337,711

[45] Jul. 6, 1982

[54] METHOD FOR COMBUSTION OF PETROLEUM AND SOLID WASTES

[76] Inventor: Clifford Bolton, 1094 Third Line, Oakville, Ontario, L6L 4B1, Canada

[21] Appl. No.: 189,268

[22] Filed: Sep. 22, 1980

[51] Int. Cl.[3] ..... F23G 7/00

[52] U.S. Cl. ..... 110/346; 110/235; 110/238

[58] Field of Search ..... 110/235, 238, 346, 196, 110/197, 102, 263, 347

[56] References Cited

U.S. PATENT DOCUMENTS 3,516,777 6/1970 Himes et al. ..... 110/238 X 3,838,651 10/1974 Dingwell ..... 110/238

3,881,430 5/1975 Katz ..... 110/238

*Primary Examiner*—Edward G. Favors

*Attorney, Agent, or Firm*—Arne I. Fors

[57] ABSTRACT

A method and apparatus for the combustion of semi-solid and liquid petroleum wastes are disclosed. The petroleum wastes such as crankcase oil are mixed with particulate combustible solids such as wood chips and shavings in a ratio in the range of, by volume, 30:70 to 75:25; preferably a ratio in the range of 30:70 to 40:60 during the start-up and in the range of 60:40 to 75:25 during normal operation.

9 Claims, 4 Drawing Figures

METHOD FOR COMBUSTION OF PETROLEUM AND SOLID WASTES

BACKGROUND OF THE INVENTION

This invention relates to a method for combustion of semi-solid and liquid petroleum wastes and, in particular, relates to a method of combustion of semi-solid and liquid petroleum wastes with particulate combustible solids.

Oil and water sludges, crankcase oil, oil and water emulsions and the like oil-based liquid petroleum wastes often are discarded by burial in land-fill sites or disposal in the oceans, with attendant disposal problems, due to difficulty in burning the petroleum component with the use of conventional burners because of the presence of occluded water and solids which make the petroleum wastes usually difficult to ignite and to burn with a sustained flame. U.S. Pat. Nos. 3,958,518 and 4,026,223 disclose incinerators for combusting oil-water sludges having complex structures for flash evaporating the water content.

Wood chips and shavings, straw, particulate paper and cardboard, on the other hand, are easy to ignite and burn but combustion is very rapid and is difficult to control. Accordingly, these materials often are discarded and, although they do not pose a disposal problem insofar as ecology is concerned, a large and valuable source of heat and energy is lost.

It is known to burn wood chips and other wood waste, as disclosed in U.S. Pat. Nos. 974,322; 3,782,298; and 4,184,436. However, the apparatus disclosed in these patents is complex and not well suited for domestic use or adaptation to existing furnaces.

U.S. Pat. No. 3,985,085 discloses a combined incinerator for oil sludge and/or solid wastes such as garbage. This incinerator does not appear suited for adaptation to existing furnaces and does not provide for recovery of heat.

None of the aforementioned patents suggests the combination of liquid petroleum wastes and forest or agriculture products fed to conventional existing domestic or industrial furnaces by a novel feeding system for combustion and recovery of heat values.

STATEMENT OF INVENTION

I have found that liquid petroleum wastes can be mixed with particulate forest and agriculture wastes such as wood chips, shavings and sawdust or with straw, particulate corn husks and the like and the resulting mixture easily ignited and burned at a controlled rate with excellent heat and energy output and production of little, if any, ash or other waste.

More particularly, my invention is directed to a method for controllably combusting liquid petroleum wastes which comprises mixing particulate organic combustible solids with said liquid petroleum wastes in the range of about 30 to 75% by volume liquid petroleum wastes and 70 to 25% by volume particulate solids and feeding said mixture of liquid petroleum wastes and particulate solids at a controlled rate to a combustion chamber for combustion therein.

It is a principal object of the present invention to provide a method for burning liquid petroleum wastes with discrete combustible solids to recover heat values therefrom in a controlled manner without polluting the environment.

It is another object of my invention to provide a simple and inexpensive apparatus which is positive in operation and which can be readily adapted for use with conventional burner systems.

BRIEF DESCRIPTION OF THE DRAWINGS

These and other objects of the invention and the manner in which they can be attained will become apparent from the following detailed description of the method and apparatus of the invention taken in conjunction with the accompanying drawings, in which.

Like reference characters refer to like parts throughout the description of the drawings.

DESCRIPTION OF THE PREFERRED EMBODIMENT

The liquid petroleum wastes combusted by the method of my invention comprise oil and water sludges, crankcase oil, oil and water emulsions and the like difficult to break or to clean oil mixtures with contaminating liquids and/or emulsion-stabilizing solids. The term "liquid petroleum wastes" will be understood to include semi-solid petroleum such as residues from petroleum distillation and reclamation processes as well as oil mixtures or emulsions heavy with organic or inorganic solids. The discrete combustible solids mixed with the liquid petroleum wastes may be forest and/or agriculture wastes such as wood chips, shavings and sawdust from saw mills and woodworking shops or straw, particulate corn husks and the like farm products.

The addition of said particulate solids to petroleum wastes allows the liquid petroleum wastes to be fed at a controlled rate to a combustion chamber with concurrent combustion of the solids and liquid mixture. I have found that a ratio of petroleum wastes to particulate solids within the range of 30:70 to 75:25, by volume, permits optimum operation. The use of more than 75% by volume petroleum wastes in the mixture presents ignition problems and sustained flame problems and the use of less than 30% by volume petroleum wastes results in unduly rapid combustion of the particulate solids.

I have further found that a higher content of particulate solids assists start-up of the process, particularly if the petroleum wastes have a high water content. Thus a ratio of petroleum wastes to particulate solids in the range, by volume, of 30:70 to 40:60 is preferred during start-up with the quantity of the particulate solids reduced once operating stability has been attained to 25 to 40% by volume of the mixture for a ratio in the range for petroleum wastes to particulate solids of 60:40 to 75:25.

The mixture of petroleum wastes and particulate solids can be prepared in a mixer having an impeller or rotating vane, well known in the art. The discrete particles preferably are immersed in the petroleum wastes for at least one hour to enhance saturation of the porosity of the solids by the liquid petroleum wastes at ambient pressure.

Figure 1:
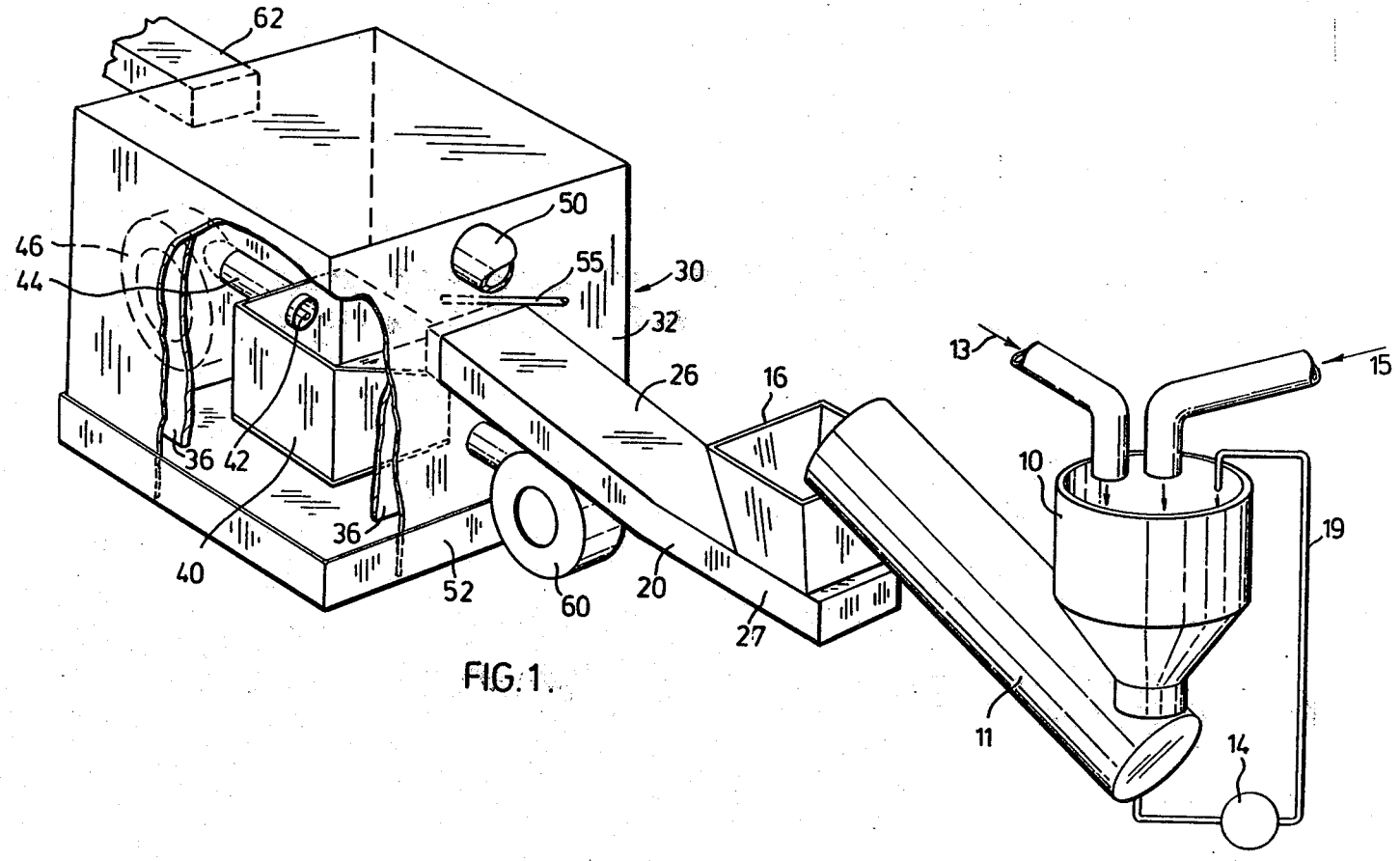
FIG. 1 is a perspective view of a feed and burner apparatus for carrying out the method of my invention.
Figure 2:
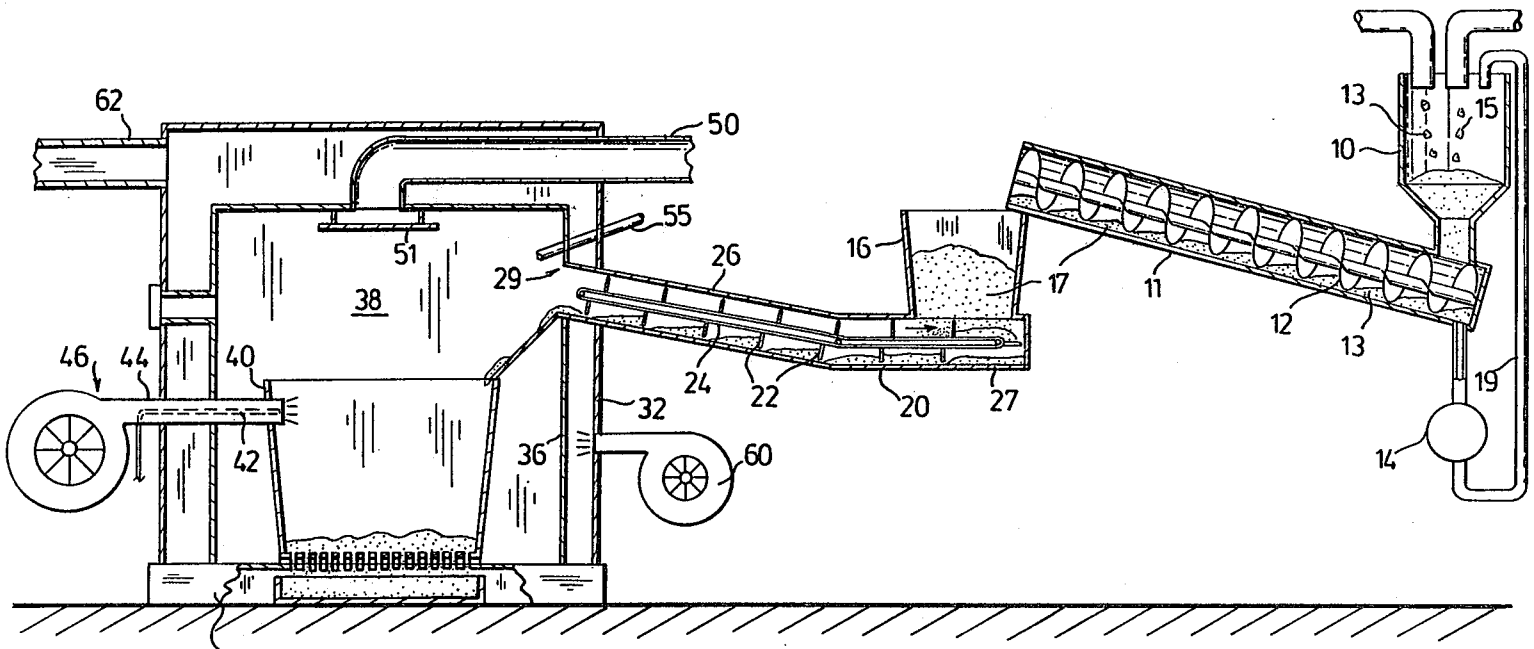
FIG. 2 is a longitudinal section of the apparatus illustrated in FIG. 1.
Figure 3:
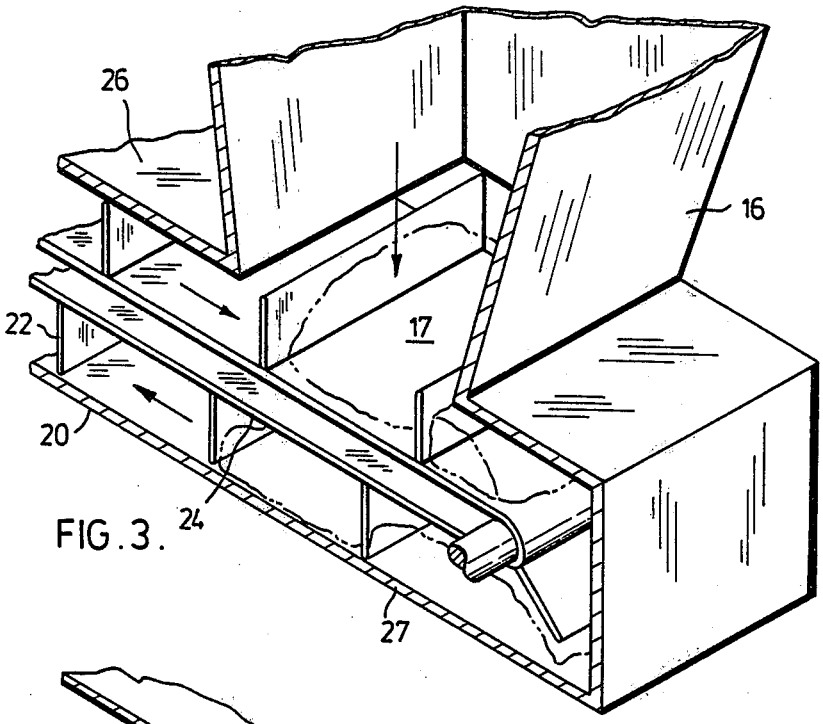
FIG. 3 is a perspective view, partly cut away, of the feeder conveyor employed.
Figure 4:
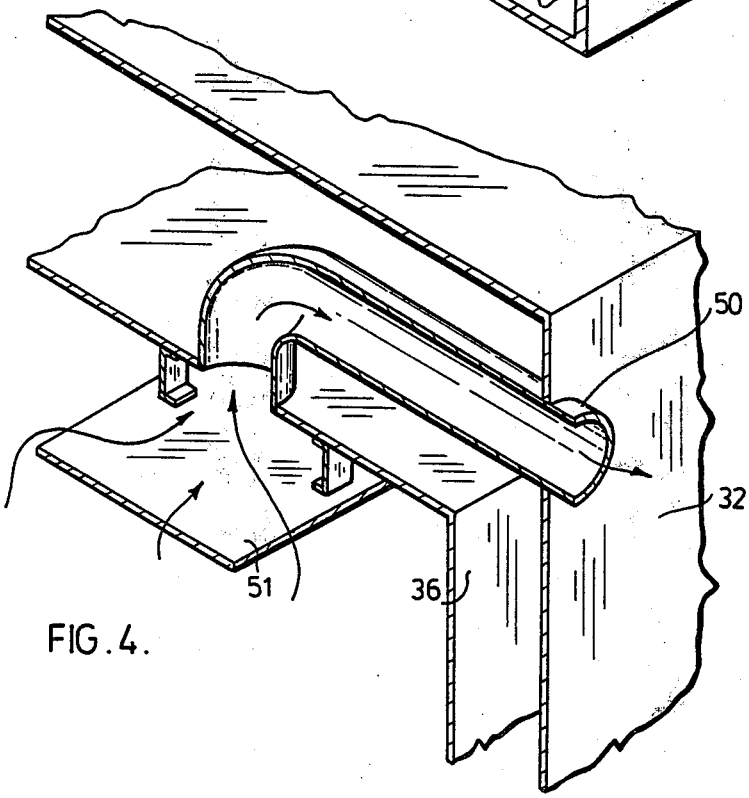
FIG. 4 is a perspective view, partly cut away, of the furnace flue baffle.

With reference now to the FIGS. 1 and 2 of the drawings, a preferred embodiment of the apparatus of my invention is shown to comprise a tank 10 having an auger mixer 11 disposed below with internal helix or vanes 12 rotatably mounted, by conventional means, for mixing liquid petroleum wastes 13 with particulate solids 15. The size of tank 10 and mixer 11 is such that an average retention time of at least one hour is provided to the mixture 17 before the mixture is discharged onto conveyor 20 by way of hopper 16. A circulating pump 14 receives excess liquid petroleum from mixer 11 for circulation to tank 10 by line 19.

Conveyor 20, commonly known as a Redler (Trademark) conveyor, which comprises a series of transverse paddles 22 equidistantly mounted on endless conveyor chain 24, is adapted to pass through a closed metal trough 26.

Conveyor 20 is inclined at an angle to the horizontal of about 10° to permit excess liquid petroleum wastes to drain back in to the lower portion 27 such that the liquid petroleum wastes normally do not exceed the 75% by volume upper limit.

The discharge end 29 of Redler conveyor 20 extends into furnace 30 through sidewall 32 such that the mixture of liquid and solids 17 is discharged through the wall 36 of burner chamber 38 into combustion box 40 for ignition and combustion therein.

A conventional gas or oil burner 42 preferably disposed within the conduit 44 of blower 46 normally is used for the initial start-up to bring the liquid-solids mixture up to the desired temperature at which time the combustion of the mixture will be self sustaining and the operation of the burner 42 discontinued. Conventional temperature controls, well known in the art, are employed to monitor and control the use of the auxiliary conventional burner.

Combustion products are discharged from the furnace 30 by a conventional chimney 50 having flue baffle 51. Very little, if any, ash is normally produced in that the petroleum component of the liquid petroleum wastes and the cellulose or lignum component of the forest or agricultural particulate solid are essentially consumed during the combustion process. Inorganic solids such as silt or clay which may be present as emulsion stabilizers in oil and water emulsions normally will be collected as a residue and removed from the combustion chamber as an ash. These incombustible solids constituents of the mixture comprise a very small fraction of a percent of the total mixture and at the most little ash need be removed from the furnace by use of ash compartment 52.

The Redler conveyor is operated at a variable speed and the rate of combustion of the liquid-solids mixture can be readily controlled by the rate at which the feed is introduced to the combustion chamber. The nature of the Redler conveyor effectively prevents flashback through the conveyor to avoid preignition of the fuel mixture.

Alternatively, the particulate solids can be fed essentially dry by means of the Redler conveyor into the furnace and the liquid petroleum wastes fed via a feed pipe, designated by broken lines 55, directly onto the particulate solids as they are discharged into the combustion box 40.

The present invention provides a number of important advantages. Filtering and screening of the liquid petroleum wastes is not required as the liquids can be introduced without pressure or nozzles mixed with or separate from the particulate solids. Thus, the feed mechanism is not affected by impurities, particles, lumps or the like liquid or solid occlusions usually present in the waste petroleum liquids. Little or no ash is produced by the operation of this process. Ancillary energy in the form of gas or oil is restricted to the initial start-up of the combustion chamber. The power required for the compressor or blower 46 can be supplied, if desired, by the addition of a steam boiler to the furnace system whereby the boiler can produce sufficient steam energy to operate a turbine to produce necessary electricity to operate the combustion air supply equipment.

A forced air system indicated by air blower 60 and outlet duct 62 can be used to recover much of the heat generated in combustion chamber 38.

What I claim as new and desire to protect by Letters Patent of the United States is:

1. A method for controllably combusting liquid petroleum wastes which comprises mixing particulate combustible solids with said liquid petroleum wastes in a ratio within the range of about 30:70 to 75:25 by volume liquid petroleum wastes to particulate combustible solids and feeding said mixture of liquid petroleum wastes and particulate solids at a controlled rate to a combustion chamber for combustion therein.

2. A method as claimed in claim 1, wherein said ratio is in the range of, by volume, 30:70 to 40:60 liquid petroleum wastes to particulate combustible solids during start-up.

3. A method as claimed in claim 1, wherein said ratio is in the range of, by volume, 60:40 to 75:25 liquid petroleum wastes to particulate combustible solids during normal operation.

4. A method as claimed in claim 1, wherein said liquid petroleum wastes are selected from the group consisting of crankcase oil, oil-water sludge and oil-water emulsions.

5. A method as claimed in claim 1, wherein said particulate combustible solids are selected from the group consisting of wood chips, wood shavings, wood sawdust, straw, and particulate paper and cardboard.

6. A method as claimed in claim 1, wherein the particulate solids are saturated by the liquid petroleum wastes.

7. A method as claimed in claim 1, wherein the particulate solids are mixed with said liquid petroleum wastes in a tank and the particulate solids are withdrawn from said tank by a mixer conveyor for feed to the combustion chamber, said conveyor having drainage means for permitting excess liquid petroleum wastes to drain from the conveyor for re-cycle to the tank.

8. A method as claimed in claim 1, wherein said particulate solids are fed by a conveyor to the combustion chamber and the liquid petroleum wastes are added to the particulate solids as the solids are fed to the combustion chamber, said conveyor having means for draining excess petroleum waste therefrom.

9. A method as claimed in claim 7 or 8, wherein the conveyor is inclined at an angle of about 10° to the horizontal to permit excess petroleum waste to drain therefrom.

* * * * *